United States Patent [19]

Turner

[11] 4,345,885

[45] Aug. 24, 1982

[54] LUBRICATION SYSTEM FOR ROTARY-TROCHOIDAL ENGINES

[75] Inventor: Eugene D. Turner, West Bend, Wis.

[73] Assignee: Briggs & Stratton Corporation, Milwaukee, Wis.

[21] Appl. No.: 126,323

[22] Filed: Mar. 3, 1980

[51] Int. Cl.[3] ..... F01C 21/04

[52] U.S. Cl. ..... 418/90; 418/91

[58] Field of Search ..... 418/90, 91, 97, 98, 418/99

[56] References Cited

U.S. PATENT DOCUMENTS 3,213,837 10/1965 Keylwert ..... 418/99
3,280,812 10/1966 Peras ..... 418/97
3,405,693 10/1968 Sparrow ..... 418/98
3,811,806 5/1974 King ..... 418/90
4,011,032 3/1977 Steinwart et al. ..... 418/91

*Primary Examiner*—John J. Vrablik
*Assistant Examiner*—Jeffrey A. Simenauer
*Attorney, Agent, or Firm*—Andrus, Sceales, Starke & Sawall

[57] ABSTRACT

A lubrication system for the rotor bearing in a rotary-trochoidal engine including an oil passage extending through the housing of the engine and another oil passage extending through the eccentric to communicate with the eccentric surface carrying the rotor bearing, wherein oil is collected from one oil passage and transferred into the other for lubrication of the rotor bearing.

9 Claims, 12 Drawing Figures

LUBRICATION SYSTEM FOR ROTARY-TROCHOIDAL ENGINES

TECHNICAL FIELD

This invention relates to a lubrication system for a rotary-trochoidal engine that is adapted to furnish lubricating oil to the rotor bearing of the engine.

BACKGROUND ART

The SAE nomenclature as defined in the article entitled Rotary-Trochoidal Engine Nomenclature and Terminology—SAE J1220, published at p. 24.03 of the SAE Handbook, 1979, will be used in this description. Rotary-trochoidal engines are often referred to as Wankel engines or rotary engines.

Rotary-trochoidal engines are generally lubricated by either of two systems: charge cooled engines that incorporate lubricating oil mixed with the fuel/air mixture to lubricate the internal bearings and other surfaces of the engine, and oil cooled engines that include an oil sump to provide for lubrication cooling. Some engines combine both charge cooling and oil cooling. In general, charge cooled rotary-trochoidal engines have cooling fins and utilize air cooling for their external surfaces, whereas oil cooled rotary-trochoidal engines use water cooled housings to cool the external surfaces.

Small rotary-trochoidal engines under about 25 h.p. are usually air cooled with respect to the external surfaces and charge cooled with respect to the internal parts, thus combining lubricating oil with the fuel/air mixture. The rotary bearing in these engines is a difficult element to lubricate properly, and the engines use a large amount of lubricating oil as part of the fuel/air mixture in order to ensure a suitable level of lubrication for the rotor bearing. This invention was developed to provide a new system for lubricating the rotor bearing in a charge cooled rotary-trochoidal engine.

One of the main objects of my invention was to provide a lubrication system for the rotor bearing in a charge cooled rotary-trochoidal engine that would minimize the amount of lubricating oil required for effective lubrication of the rotor bearing. Another principal objective was to develop a lubrication system for rotary-trochoidal engines which would reduce the air pollution characteristics of the engine. Still another important object was to provide efficient lubrication of the rotor bearing in a charge cooled rotary-trochoidal engine to thereby maintain or enhance the life of the bearing. Other more specific objects will become apparent in the description which follows.

DISCLOSURE OF THE INVENTION

My present invention provides a lubrication system for a charge cooled rotary-trochoidal engine which includes a first oil passage extending through an end housing of the engine, a second oil transfer passage extending through the eccentric supporting the rotor bearing and arranged to communicate with the rotor bearing, and means to collect lubricating oil from the first oil passage and transfer it to the second oil passage for lubrication of the rotor bearing. Oil is thereby supplied to the rubbing surfaces between the eccentric and the rotor bearing. Four different specific embodiments of this technical concept are described below.

BRIEF DESCRIPTION OF THE DRAWINGS

The description is made with reference to the following.

BEST MODES FOR CARRYING OUT THE INVENTION

(A) Background Description

Figure 1:
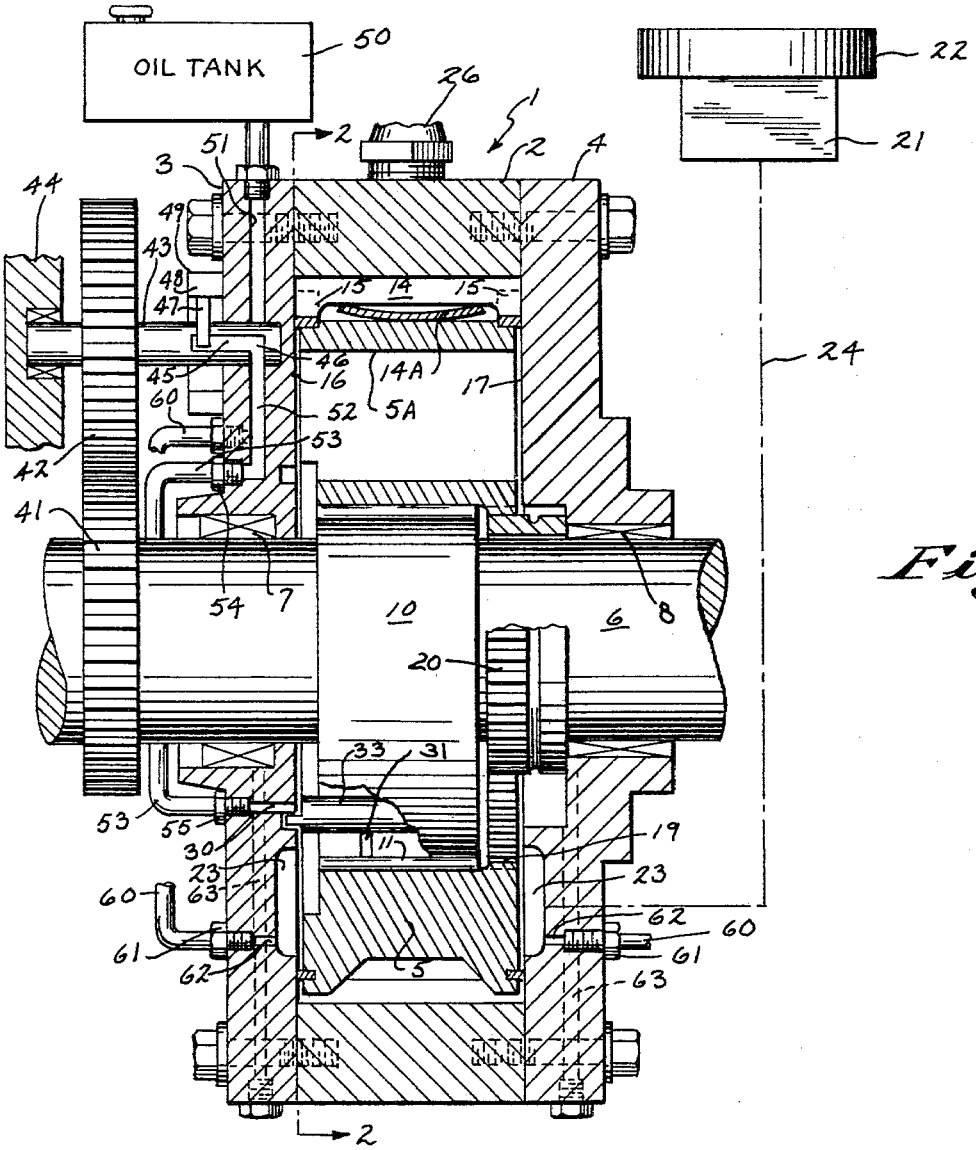
FIG. 1 is a sectional view of a rotary-trochoidal engine employing the lubrication system of the present invention.

The rotary-trochoidal engine 1 as illustrated in FIG. 1 is of typical construction, except for the addition of a lubrication system according to the present invention, and includes a two-lobed rotor housing 2 and a pair of end housings 3 and 4 which are bolted together to enclose a three-sided rotor 5. The rotor includes transverse air passages 5A, see also FIGS. 2 and 3. Crankshaft 6 is journaled in bearing 7 that is held in position in the end housing 3 and a bearing 8 secured in place in the end housing 4. The crankshaft includes an integral eccentric 10 within the rotor housing, and the rotor 5 is mounted for rotation about the center line of the eccentric along a rotor bearing 11 that surrounds the eccentric. The rotor bearing 11 is shown as a roller bearing in the drawings.

Figure 2:
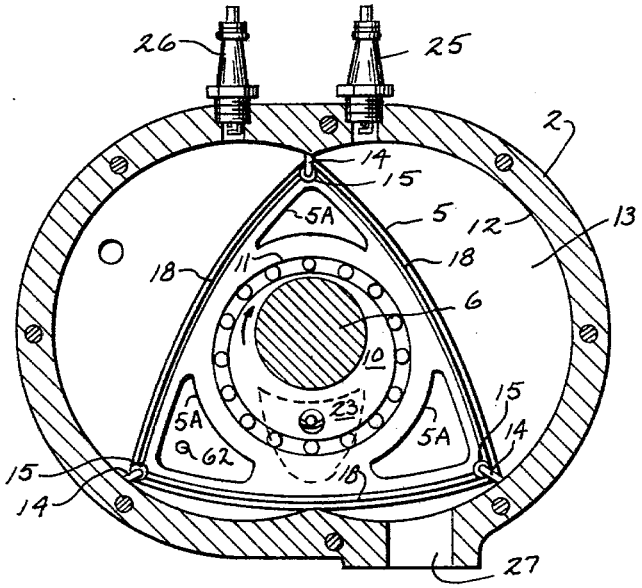
FIG. 2 is a vertical sectional view of the engine of FIG. 1.
Figure 3:
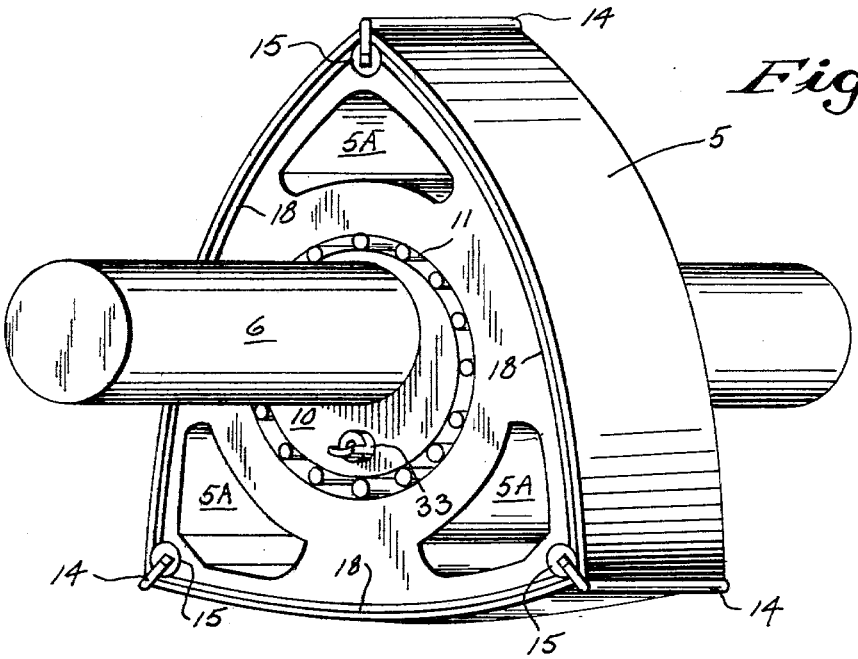
FIG. 3 is a perspective view illustrating the rotor of the engine of FIG. 1.
Figure 4:
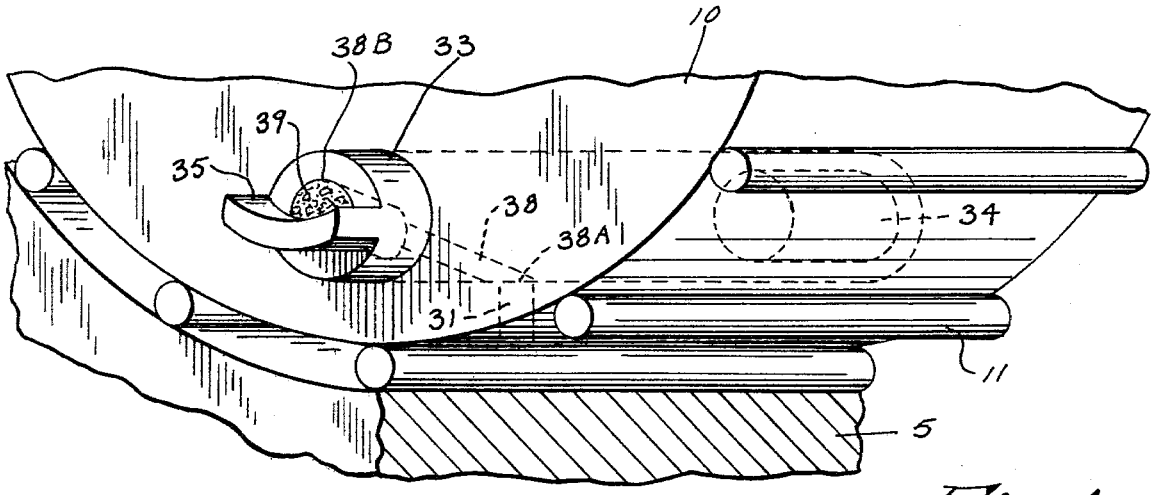
FIG. 4 is an enlarged perspective view with portions broken away of the rotor shown in FIG. 3.

Turning now to FIG. 2, the inner wall 12 of the rotor housing 2 is shaped to provide a two-lobe trochoidal chamber 13 within which the rotor 5 rotates. Apex seals 14 (see also FIG. 3) are carried in grooves at each apex of the rotor and each apex seal is biased against the inner wall 12 of the rotor housing by means of a spring 14A. Button seals 15 are positioned at each of the apices of the rotor to be in sealing contact with the inner wall 16 of the end housing 3 and the inner wall 17 of the end housing 4. Side seals 18 are located on each face of the rotor 5 to be in sealing contact with the inner walls 16 and 17 of the end housings 3 and 4, respectively, with each side seal extending from one apex of the rotor to the next. The apex seals form the primary gas seal between adjacent sections of the chamber 13 and the inner wall of the rotor housing, the side seals provide for gas sealing between the sides of the rotor and the end housings, and the button seals provide gas sealing between the apex seals and the side seals. Each of the seals may have an actuating spring or springs associated with it, e.g. apex seal spring 14A (FIG. 1), which is used to bias it towards its respective sealing surface.

The engine 1 includes timing gears to rotate the rotor at one third the speed of the crankshaft. These comprise an internally-toothed gear 19 that is secured to or formed integrally with one side of the rotor 5 and concentric with its axis of rotation and an externally toothed gear 20 which is fixed with respect to the end housing 4 and is concentric with the crankshaft. The gear 20 meshes with the gear 19 to drive the rotor, and each gear has the appropriate number of teeth relative to one another to drive the rotor at the desired speed.

A carburetor 21 receives fuel from a suitable tank, not shown, (which stores a mixture of fuel and lubricating oil in the case of a charge cooled engine) and air through air cleaner 22 to deliver the proper fuel/air mixture to intake ports 23 formed along the inner walls 16 and 17 of the end housings 3 and 4, respectively; the piping connecting the carburetor to the engine is not shown in detail in the drawings but is indicated by the phantom line 24. The fuel/air mixture is ignited within the chamber 13 by spark plugs 25 and 26, plug 25 being the leading spark plug and plug 26 the trailing spark plug when the rotor rotates clockwise in FIG. 2 as indicated by the arrow. Exhaust port 27 extends through the rotor housing to conduct exhaust gases from the chamber 13.

The rotary-trochoidal engine 1 operates in the usual fashion. The rotor rotates about the crankshaft while simultaneously tracing an eccentric path to follow the trochoidal inner wall 12 of the rotor housing 2. After the rotor passes the intake ports 23 and a fresh charge of fuel/air mixture, enters the chamber 13, continued rotation of the rotor combined with its eccentric movement compresses the fuel/air mixture, the mixture is ignited by the spark plugs with the leading plug firing first to initiate the flame front; further rotation and eccentric movement of the rotor develops the power stroke of the engine until the exhaust port is uncovered to exhaust the mixture from the combustion chamber.

The engine 1 as described to this point is of conventional construction and forms no part of this invention. The engine is illustrated schematically to represent a typical engine with which the present lubrication system can be employed, but it is pointed out that the lubrication system can be used with rotary-trochoidal engines of different structure than the engine 1.

(B) Description of the First Embodiment, FIGS. 1–7

Figure 5:
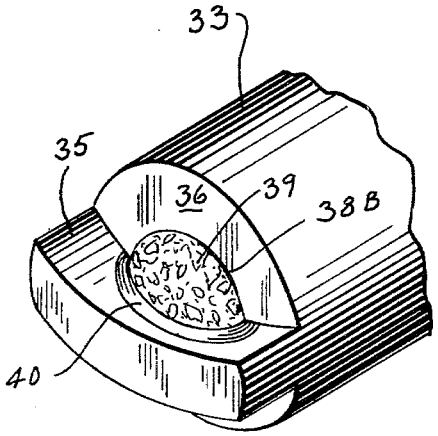
FIG. 5 is an enlarged perspective view of an element of the lubrication system of the present invention.
Figure 6:
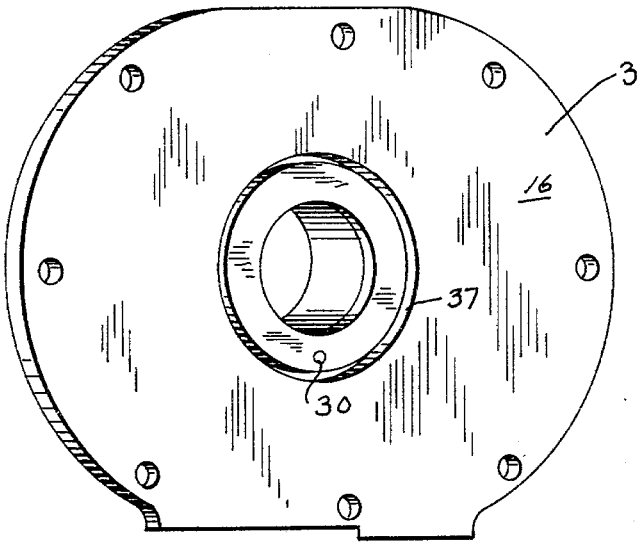
FIG. 6 is a perspective view of an end housing of the engine shown in the previous figures which incorporates another element of the present lubrication system.
Figure 7:
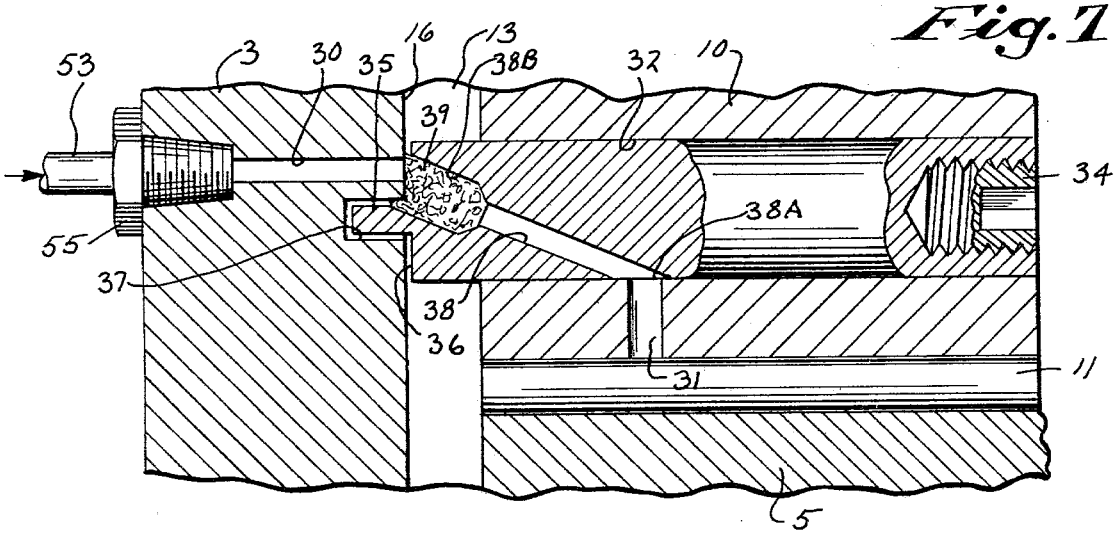
FIG. 7 is a sectional view illustrating a significant detail of the first embodiment of the present lubrication system.

As shown in FIG. 7, a first oil passage 30 extends axially through the end housing 3 to communicate with the trochoidal chamber 13 of the engine alongside an end surface of the eccentric 10. A second oil passage 31 is formed in the eccentric 10 and extends in a radial direction to communicate with the surface between the eccentric 10 and the rotor bearing 11. A bore 32 extends axially through the eccentric at a location so spaced from the axis of the crankshaft as to travel in an orbit opposite the exit end of first oil passage 30. A plug 33 is fitted into the bore 32 and retained therein by an expandable threaded element 34 threaded into one end of the plug. A lip 35 extends from the end surface 36 of the plug 33 adjacent the end housing 3 and projects into an annular groove 35 formed along the inner wall 16 of the end housing 3 concentric with the crankshaft. The annular groove 37 is best illustrated in FIG. 6. As shown in FIG. 5, the lip 35 of the plug has an arcuate shape to conform to the curvature of the annular groove 37.

The plug 33 has an oil transfer passage 38 formed therein with its entrance end 38B opening onto the end surface 36 of the plug. The oil transfer passage 38 is inclined downwardly so that its exit end 38A communicates with the second oil passage 31 extending through the eccentric. The entrance end 38B of the oil transfer passage is enlarged in relation to the balance of the passage and a small wad 39 of resilient porous material, such as steel wool, which will maintain contact with the end housing 3 is inserted into the enlarged portion. Turning again to FIG. 5, the upper surface of the lip 35 which surrounds the entrance end 38B of the oil transfer passage is slightly dished or chamfered as at 40 for improved flow of oil into the transfer passage 38. The construction of the plug 33 and its relationship to the eccentric and the rotor bearing will be further understood by reference to the perspective views of FIGS. 3 and 4.

Lubricating oil is to be supplied to the first oil passage 30 and an exemplary system is illustrated in FIG. 1. A drive gear 41 keyed to the crankshaft 6 meshes with a pump gear 42 keyed to a shaft 43. One end of the shaft 43 is journaled in a housing 44 (a portion of which is shown in the drawing) that surrounds part of the engine, and the opposite end of the shaft is journaled in the end housing 3. The shaft includes an axial passage 45 connected to a radial passage 46. A spring loaded plunger 47 is carried in the shaft 43 with its innermost end extending into the axial passage 45 and its outermost end extending beyond the shaft to contact the internal cam surface 48 of a cam member 49 attached to the end housing 3. Upon rotation of the shaft 43, the plunger will be driven in a reciprocating motion as its outermost end traverses the cam surface 48. An oil tank 50 carries a supply of lubricating oil that is fed into upper supply passage 51 formed in the end housing 3. A lower supply passage 52 is also formed in the end housing 3 and an oil supply line 53 is connected to its exit end at the threaded plug 54. The oil supply line 53 leads to the first oil passage 30 and is connected thereto by threaded plug 55.

Upon rotation of the crankshaft 6, the gears 41 and 42 rotate the shaft 43. When the radial passage 46 of the shaft lines up with the upper supply passage 51, a supply of oil enters the passage 46 and flows from there into the axial passage 45. Continued rotation of the shaft 43 causes the plunger 47 to reciprocate; when the radial passage 46 is lined up with the lower passage 52, the reciprocating movement of the plunger develops a pumping action that causes oil to flow into the lower passage 52 and thence through the supply line 53 into the first oil passage 30. Oil supply mechanisms other than that just described may be employed with the rotor bearing lubricating system of this invention.

The operation of the rotor bearing lubrication system is as follows: Upon rotation of the crankshaft, the plug 33 carried by the eccentric orbits about the axis of the crankshaft. Oil pumped through the oil supply line 53 flows through the first oil passage 30; when the plug 33 comes into alignment with the discharge end of the first oil passage, which occurs once during each revolution of the eccentric, oil is collected on the lip 35 of the plug 33. The oil is then conducted through the oil transfer passage 38 of the plug into the second oil passage 31, from whence it flows to the rubbing surface between the rotor bearing 11 and the eccentric 10. Thus the plug 33 functions as an oil collector and transfer means to collect lubricating oil from the first passage and transfer it to the second oil passage for lubrication of the rotor bearing. The lip 35 of the plug extending into the annular groove 37 in the end housing also minimizes loss of oil supplied for this purpose.

Lubricating oil also may be supplied for the main bearings, apex seals, housing, etc., by the above arrangement. A second lower supply passage can be formed in the end housing 3 behind the supply passage 52, so that it does not appear in FIG. 1, and connected to oil supply line 60 that leads to threaded plug 61 where it is connected to a passage 62. The passage 62 communicates with a bearing passage 63 formed in the end housing and leading to the main bearing 7; a similar passage 63 is formed in the end housing 4 and leads to main bearing 8. The passage 62 also opens onto the inner wall 16 of the end housing 3 along intake port 23 to supply oil for lubrication of the apex seals and the seals on the rotor. When the radial passage 46 in the shaft 43 is lined up with the second lower supply passage, a quantity of oil will be transferred into the supply line 60 for lubricating the foregoing elements under the pumping action of the reciprocating plunger 47. Oil passages 62 and 63 are also formed in the end housing 4 for lubrication of internal parts along the right side of the engine as viewed in FIG. 1, and an oil supply line similar to line 60 would lead to the passage 62 in end housing 62.

Figure 8:
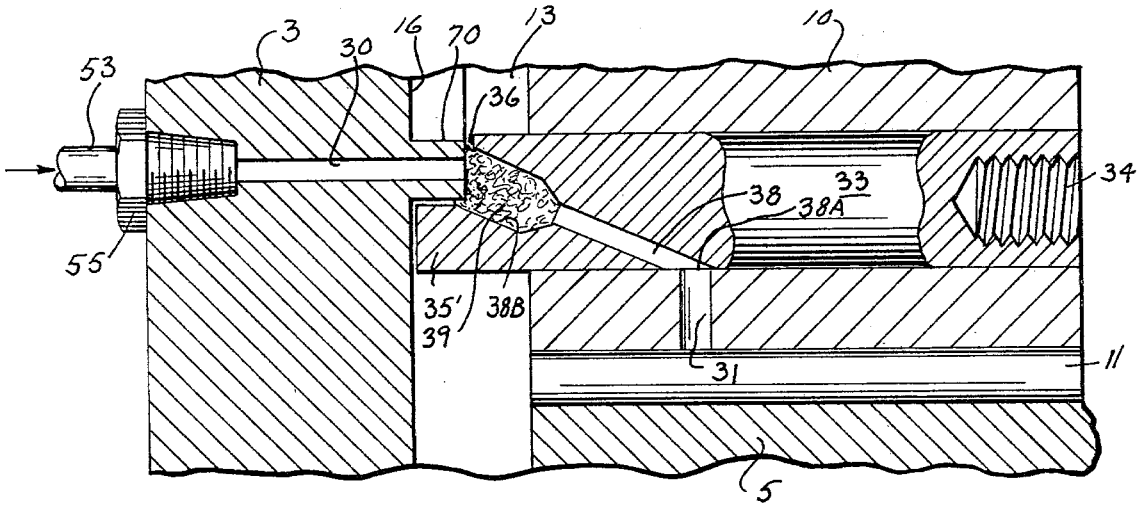
FIG. 8 is a sectional view similar to FIG. 7 illustrating the second embodiment of a lubrication system according to the present invention.

(C) Description of Second Embodiment, FIG. 8

The second embodiment of this invention as illustrated in FIG. 8 incorporates the same concept as the first except that an annular ring 70 is joined to the interior wall 16 of the end housing 3, being formed either as an integral portion thereof or a separate ring member affixed to the wall; thus, there is no annular groove in the end housing in this version. The first oil passage 30 extends through the annular ring 70 to communicate with the trochoidal chamber 13 as illustrated. The lip 35' extending from the end surface 36 of plug 33 adjacent the end housing 3 is enlarged in relation to the lip 35 illustrated in the first embodiment, and the lip 35' is arcuate to conform to the curvature of the annular ring 70. Oil supplied to the first oil passage 30 exits from the opening of the passage along the ring 70 from where it is collected by the plug 33 and conducted through oil transfer passage 38 formed in the plug and into the second oil passage 31 for lubrication of the rubbing surfaces about the rotor bearing 11. This embodiment of the invention obviates the need to machine an annular groove along the interior wall of the end housing 3 and also reduces the machining required for the end of the plug 33 on which the lip 35' is formed.

Figure 9:
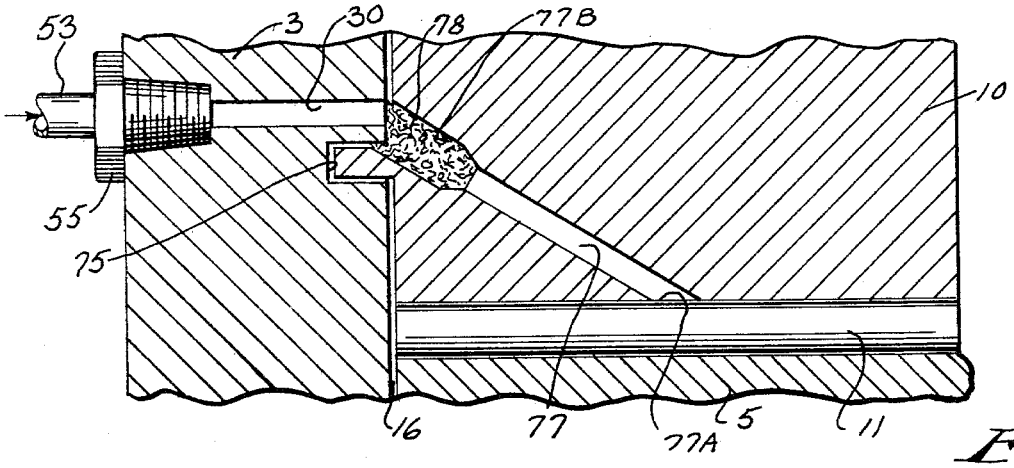
FIG. 9 is a sectional view similar to FIG. 7 illustrating the third embodiment of the present invention.
Figure 10:
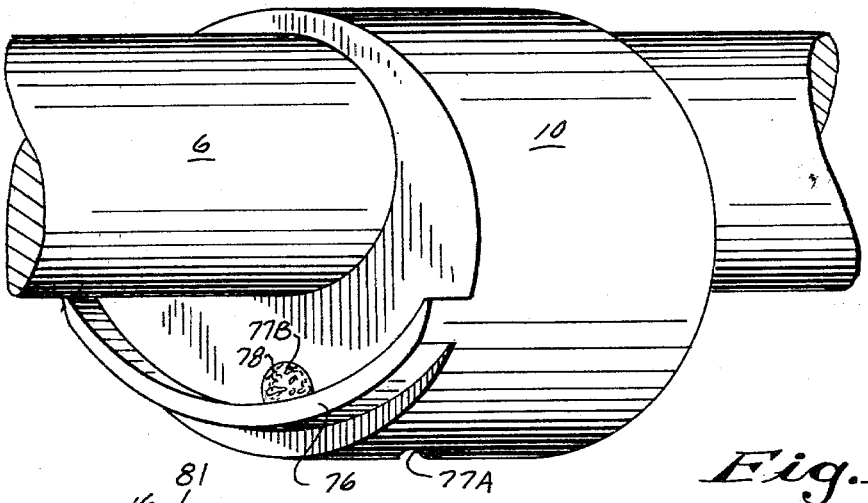
FIG. 10 is a perspective view illustrating an element of the lubricating system shown in FIG. 9.

(D) Description of Third Embodiment, FIGS. 9 & 10

In the third embodiment of FIGS. 9 and 10, the first oil passage 30 extends axially through the end housing 3 and is connected with oil supply line 53 as in the prior embodiments. An annular groove 75 is formed along the inner wall 16 of the end housing 3. As best shown in FIG. 10, the eccentric 10 includes an arcuate lip 76 which may be formed as an integral part of the end surface of the eccentric; the arcuate lip 76 projects into the groove 75. The second oil passage 77 is formed in the eccentric 10 and has one end opening on the end surface of the eccentric near the lip 76 and extends in an inclined direction to communicate at its exit end 77A with the rubbing surface between the eccentric 10 and the rotor bearing 11. The entrance end 77B of the second oil passage 77 is positioned adjacent the exit end of the first oil passage 30 and is enlarged to receive a wad 78 of steel wool. A dish-like depression may be formed in the lip 76 about the opening of passage 77 on the end surface of the eccentric as in the first embodiment. During the operation of the engine, the lip 76 of the eccentric 10 rides within the groove 75 formed in the end housing 3 and is slightly spaced therefrom so as not to interfere with rotation of the eccentric. Oil supplied into the first oil passage 30 is collected by the lip 76 and wad 78 and thence conducted through the second oil passage 77 to lubricate the rotor bearing 11. Thus, the lip 76 functions as an oil collector and transfer means that collects oil from the first oil transfer passage and transfers it to the second oil passage in the eccentric in the same manner as the plug 38 in the previous embodiments.

Figure 11:
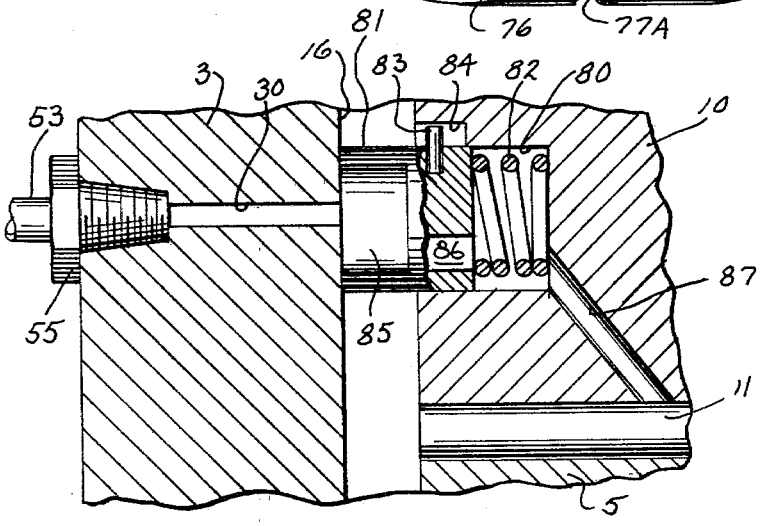
FIG. 11 is a sectional view similar to FIG. 7 showing the fourth embodiment of a lubrication system of the present invention.
Figure 12:
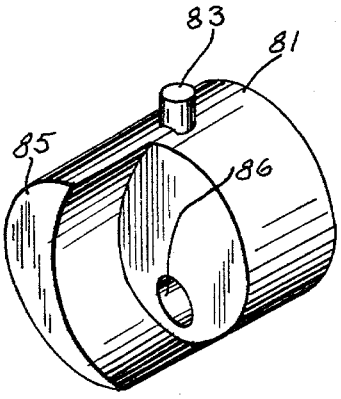
FIG. 12 is a perspective view of an element of the lubrication system of FIG. 11.

(E) Description of Fourth Embodiment, FIGS. 11 & 12

Referring first to FIG. 11, the first oil passage 30 exits upon the inner wall 16 of the end housing 3. A bore 80 extends partly into the eccentric 10 at a position adjacent the exit end of the first oil passage. Plug 81 is inserted into the bore 80 and biased to ride against the inner wall 16 of the housing under the action of the spring 82 between the end of the plug and the bottom of the bore. The plug 81 includes a radially projecting pin 83 that is received in a keyway 84 formed in the eccentric to thereby retain the plug 81 in position without rotation. The plug 81 (FIG. 12) is formed to have an arcuate lip element 85 projecting from one side of its end surface adjacent the end housing; an axial passage 86 extends through the plug and opens near the lip at one end of the plug to act as an oil transfer passage. Second oil passage 87 communicates with the innermost end of the bore 80 and extends in an inclined direction to the rubbing surface between the rotor bearing 11 and the eccentric 10.

The spring 82 acts to bias the plug 81 to engage the inner wall 16 of the end housing 3 so that the plug is in the nature of a spring loaded face seal or wiper. During operation of the engine, oil from the first oil passage 30 that is collected by plug 81 flows through the transfer passage 86 and into the second oil passage 87 to lubricate the rotor bearing 11. The structure of this fourth embodiment eliminates the steel wool as used in prior versions of this invention and minimizes the machining required for the end housing.

There has thus been described a lubrication system for the rotor bearing in a rotary-trochoidal engine combining a first oil passage extending through an end housing of the engine, a second oil passage formed in the eccentric on which the rotor and rotor bearing are carried, and oil collector and transfer means arranged to collect lubricating oil from the first oil passage and transfer it to the second oil passage to thereby effect lubrication of the rotor bearing. Various specific embodiments of the invention have been disclosed to enable those skilled in the art to adequately practice its teachings, but it should be pointed out that changes can be made in the disclosed embodiments and other versions can be developed that will be within the present concept.

As discussed previously, the lubrication system of the present invention is particularly adaptable for use with a charge cooled rotary-trochoidal engine that depends upon mixing lubricating oil with fuel in order to obtain adequate lubrication of the interior parts of the engine. Such engines typically operate at an oil-to-fuel ratio in the range of about 1:25, i.e. 1 part lubricating oil per 25 parts of fuel on a volume basis. In contrast, I have found that when a charge cooled rotary-trochoidal engine is equipped with a lubrication system of the present invention, only about one-fourth to one-sixth this amount of oil is required in order to properly lubricate the rotor bearing and, furthermore, that the bearing was better lubricated than was the case with a charge cooled engine not having the present system. When the oil supply means used to furnish oil to the first oil passage of the present rotor bearing lubrication system is also employed to furnish oil for lubrication of the main bearings, apex seals, and other internal parts of the engine as discussed above in connection with FIG. 1, there is no need to mix lubricating oil with the fuel for the engine. This has the added advantage of reducing the air pollution characteristics of the engine by reducing the amount of oil burned during the combustion process. The lubrication system for the rotor bearing as described in the above embodiments, however, can also be used together with the addition of lubricating oil to the fuel as a source for lubrication of other internal parts of the engine; in this instance, a lesser amount of oil would need to be added to the fuel than is the case with the usual charge cooled engine without the present rotor bearing lubrication system.

I claim:

1. In a rotary-trochoidal engine having (a) a housing formed by a rotor housing defining a trochoidal chamber and a pair of opposed end housings joined thereto, (b) a crankshaft journaled in the end housings and having an eccentric positioned in the trochoidal chamber, and (c) a rotor supported on a rotor bearing carried on a surface of the eccentric, a lubrication system for supplying lubricating oil for the rotor bearing comprising, in combination:

(1) a first oil passage extending through a first of said end housings, (2) a second oil passage in the eccentric, one end of said second passage disposed in communication with the surface of the eccentric on which the rotor bearing is carried and the opposite end of said second passage disposed to register with said first passage as the eccentric rotates within the housing, (3) means for supplying lubricating oil to said first passage, and (4) a collecting member disposed within said opposite end of said second passage and disposed to ride against the inner surface of said first end housing to thereby collect oil emerging from said first passage and transfer said oil to said second passage and hence to said rotor bearing.

2. The combination of claim 1, wherein said collecting member is resiliently biased into contact with said inner surface.

3. The combination of claim 1, wherein said collecting member is a resilient mass of fibrous metal.

4. The combination of claim 1, wherein said collecting member comprises a plug disposed within said opposite end of said second passage, and said combination further includes biasing means to urge the plug into contact with said inner surface.

5. In a rotary-trochoidal engine having (a) a housing formed by a rotor housing defining a trochoidal chamber and a pair of opposed end housings joined thereto, (b) a crankshaft journaled in the end housings and having an eccentric positioned in the trochoidal chamber, and (c) a rotor supported on a rotor bearing carried on a surface of the eccentric, a lubrication system for supplying lubricating oil for the rotor bearing comprising, in combination:

(1) a first oil passage extending through one of the end housings, said one end housing includes an annular groove along its inner wall;

(2) a second oil passage in the eccentric in communication with the surface of the eccentric on which the rotor bearings is carried;

(3) oil collector and transfer means carried by the eccentric and arranged to collect lubricating oil from the first oil passage and transfer it to the second oil passage for lubrication of the rotor bearing, said oil collector and transfer means comprises a member carried by the eccentric and having (i) an end surface positioned adjacent the inner wall of said one housing, (ii) a lip element projecting from the end surface and extending into the annular groove of said one end housing, and (iii) an oil transfer passage in communication with the end surface of the member at one end and with the second oil passage at its other end.

6. The combination of claim 5 further including:

additional oil passages formed in the housing for conducting oil to bearings in which the crankshaft is journaled and to apex seals carried on the rotor; and means for supplying lubricating oil to the first oil passage and to the additional oil passages.

7. In a rotary-trochoidal engine having (a) a housing formed by a rotor housing defining a trochoidal chamber and a pair of opposed end housings joined thereto, (b) a crankshaft journaled in the end housings and having an eccentric positioned in the trochoidal chamber, and (c) a rotor supported on a rotor bearing carried on a surface of the eccentric, a lubrication system for supplying lubricating oil for the rotor bearing comprising, in combination:

(1) a first oil passage extending through a first of said end housings, (2) a second oil passage in the eccentric, one end of said second passage disposed in communication with the surface of the eccentric on which the rotor bearing is carried and the opposite end of said second passage disposed to register with said first passage as said eccentric rotates within said housing, said second passage extending in an inward radial direction whereby centrifugal force will act to move oil through said second passage to said rotor bearing, (3) means for supplying lubricating oil to said first passage, (4) a collecting member disposed within said opposite end of said second passage and disposed to ride against the inner surface of said first end housing to thereby collect oil emerging from said first passage and transfer said oil to said second passage, and (5) a lip element located radially outward of said opposite end of said second passage and extending across the clearance between the inner surface of said first end housing and the adjacent surface of said eccentric.

8. The combination of claim 7, wherein said lip element is disposed on one of said eccentric and said first end housing and the other of said eccentric and said first end housing has a groove to receive said lip element.

9. The combination of claim 8, wherein said lip is curved and is concentric with the axis of rotation of said rotor.

* * * * *

UNITED STATES PATENT AND TRADEMARK OFFICE

CERTIFICATE OF CORRECTION

PATENT NO. : 4,345,885

DATED : August 24, 1982

INVENTOR(S) : EUGENE D. TURNER

It is certified that error appears in the above-identified patent and that said Letters Patent is hereby corrected as shown below:

Col. 4, line 1, Cancel "groove 35" and substitute therefor ---groove 37---' Col. 8, line 17, CLAIM 5, Cancel "bearings" and substitute therefor ---bearing---.

Signed and Sealed this

*Sixteenth* Day of *November 1982*

[SEAL]

*Attest:*

GERALD J. MOSSINGHOFF

*Attesting Officer*

*Commissioner of Patents and Trademarks*